US008816590B2

(12) United States Patent
Kuo

(10) Patent No.: US 8,816,590 B2
(45) Date of Patent: Aug. 26, 2014

(54) LIGHTING DEVICE WITH ADJUSTABLE COLOR TEMPERATURE

(75) Inventor: Te-Wen Kuo, Hsinchu (TW)

(73) Assignee: Advanced Optoelectronic Technology, Inc., Hsinchu Hsien 303 (TW)

( * ) Notice: Subject to any disclaimer, the term of this patent is extended or adjusted under 35 U.S.C. 154(b) by 394 days.

(21) Appl. No.: 13/224,340

(22) Filed: Sep. 2, 2011

(65) Prior Publication Data

US 2012/0119665 A1 May 17, 2012

(30) Foreign Application Priority Data

Nov. 15, 2010 (CN) ..... 2010 1 0542364

(51) Int. Cl.
*H05B 37/02* (2006.01)

(52) U.S. Cl.
USPC ..... 315/192; 315/307

(58) Field of Classification Search
CPC ..... H05B 37/00; H05B 37/02; H05B 33/08; H05B 33/0803; H05B 33/0806; H05B 33/0896; H05B 33/0833; H05B 33/0821; H05B 33/0824; H05B 33/0827; H05B 33/083; H05B 33/0815
USPC ..... 315/192, 291, 307, 308, 309, 294, 312, 315/185 R, 193
See application file for complete search history.

(56) References Cited

U.S. PATENT DOCUMENTS

| | | | | |
|---|---|---|---|---|
| 7,148,632 | B2 * | 12/2006 | Berman et al. | 315/189 |
| 7,902,771 | B2 * | 3/2011 | Shteynberg et al. | 315/307 |
| 8,227,999 | B2 * | 7/2012 | Van Herpen et al. | 315/250 |
| 2006/0175985 | A1 | 8/2006 | Huynh et al. | |
| 2007/0279440 | A1 | 12/2007 | Negley | |
| 2011/0001435 | A1 * | 1/2011 | Wray | 315/291 |
| 2012/0104977 | A1 * | 5/2012 | McKenzie et al. | 315/312 |

FOREIGN PATENT DOCUMENTS

| | | | |
|---|---|---|---|
| CN | 2924284 | Y | 7/2007 |
| TW | 200806081 | A | 1/2008 |
| TW | M377528 | | 4/2010 |

* cited by examiner

*Primary Examiner* — David H Vu
(74) *Attorney, Agent, or Firm* — Novak Druce Connolly Bove + Quigg LLP

(57) ABSTRACT

A lighting device with adjustable color temperature includes a power, a driver, and a plurality of branches. The power is electrically connected to the driver for supplying power to the driver. Each of the branches includes a light source and an adjustor connected in series. The adjustor controls the color temperature of the light source in a corresponding branch by adjusting the voltage through the corresponding branch.

5 Claims, 1 Drawing Sheet

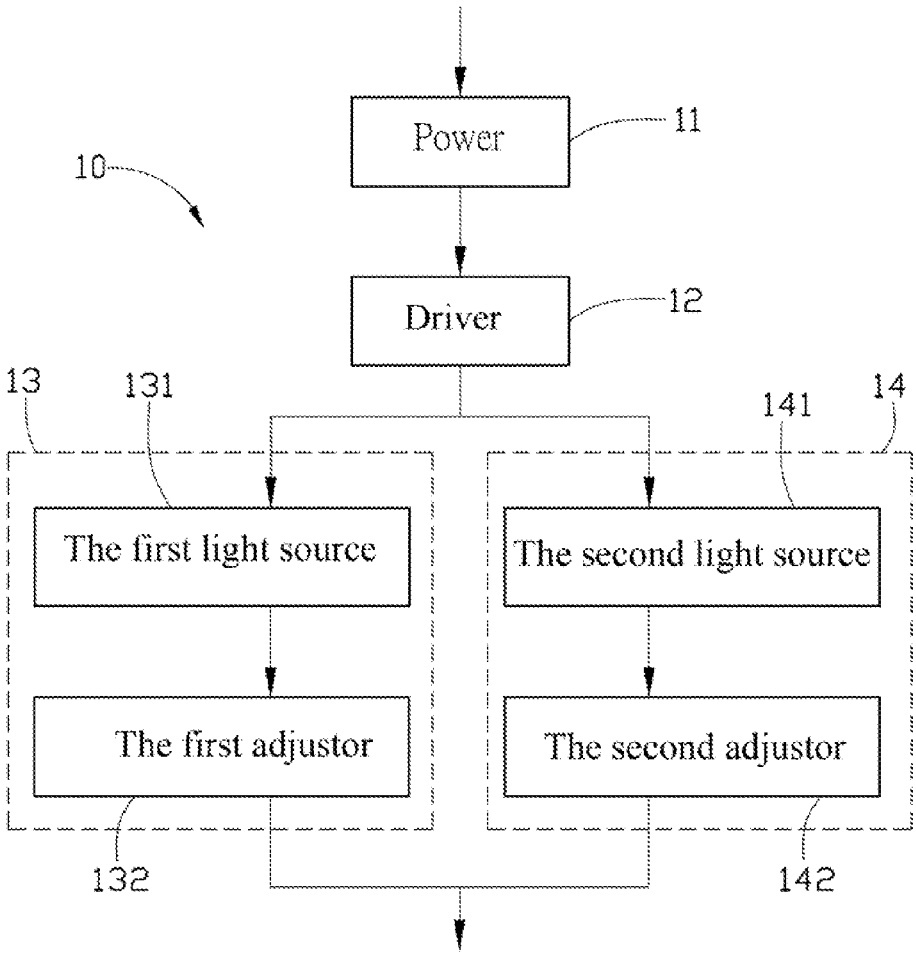
Power
11
10
Driver
12
13
131
141
14
The first light source
The second light source
The first adjustor
The second adjustor
132
142

LIGHTING DEVICE WITH ADJUSTABLE COLOR TEMPERATURE

BACKGROUND

1. Technical Field

The disclosure relates to lighting devices, and particularly to a lighting device in which color temperature can be adjusted.

2. Description of the Related Art

Light emitting diodes' (LEDs) many advantages, such as high luminosity, low operational voltage, low power consumption, compatibility with integrated circuits, easy driving, long term reliability, and environmental friendliness. These advantages have promoted their wide use as a light source. Now, light emitting diodes are commonly applied in environmental lighting.

A common lighting device has one color temperature. If consumers need or want a different color temperature, they must exchange the lighting device for a different one, which is inconvenient and costly for consumers.

Therefore, it is desirable to provide a lighting device which can overcome the described limitations.

BRIEF DESCRIPTION OF THE DRAWINGS

Many aspects of the disclosure can be better understood with reference to the only drawing. The components in the only drawing are not necessarily drawn to scale, the emphasis instead being placed upon clearly illustrating the principles of the present lighting device.

The only figure is a block diagram of a lighting device in accordance with a first embodiment.

DETAILED DESCRIPTION

An embodiment of a lighting device with adjustable color temperature as disclosed is described in detail here with reference to the only drawing.

Referring to the only figure, a lighting device 10 includes a power 11, a driver 12, a first branch 13, and a second branch 14.

The power 11 is used to transform an AC current to a DC current output with a stable DC voltage. The driver 12 is used for providing a stable DC voltage input to each of the branches 13, 14.

The first branch 13 includes a first light source 131 and a first adjustor 132 connected in series. The driver 12 electrically connects to the first branch 13. The driver 12 is used for providing the stable DC voltage input to the first branch 13. Understandably, there may be more than one first light source 131. The first adjustor 132 adjusts a brightness of the first light source 131 by controlling a voltage of the first branch 13. In this embodiment, the first light source 131 is cool light source. A color temperature of the first light source 131 is higher than 4000K, such as 6000K. The first light source 131 can be a plurality of LED chips in series or in parallel.

The second branch 14 is connected parallel to the first branch 13. The second branch 14 includes a second light source 141 and a second adjustor 142 connected in series. The driver 12 electrically connects to the second branch 14. The driver 12 is used for providing a stable DC voltage input to the second branch 14. Understandably, there can be more than one second light source 141. The second adjustor 142 adjusts a brightness of the second light source 141 by controlling a voltage of the second branch 14. In this embodiment, the second light source 141 is a warm light source. A color temperature of the second light source 141 is lower than 4000K, such as 2000K. The second light source 141 can be a plurality of LED chips in series or in parallel.

Understandably, the color temperatures of the first branch 13 and the second branch 14 are different. The number of branches can be set according to need.

Thus, the color temperature and brightness of the lighting device 10 can be adjusted.

While the disclosure has been described by way of example and in terms of exemplary embodiment, it is to be understood that the disclosure is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A lighting device with adjustable color temperature comprising: a power, a driver, and a plurality of branches, the power electrically connecting to the driver, the driver respectively connecting to each of the branches, the branches connecting with each other in parallel, wherein each of the branches includes a light source and an adjustor connected in series, the adjustor adjusts a brightness of the light source by controlling a voltage of each of the branches, and the color temperatures of the light sources of at least two of the branches are different, wherein the number of the branches is two, and the branches are respectively a first branch and a second branch, and wherein the light source of the first branch is cool light source, a color temperature of the light source of the first branch is higher than 4000K, the light source of the second branch is warm light source and a color temperature of the light source of the second branch is lower than 4000K.

2. The lighting device with adjustable color temperature of claim 1, wherein the light source is an LED.

3. The lighting device with adjustable color temperature of claim 2, wherein the LED includes at least one LED chip.

4. The lighting device with adjustable color temperature of claim 3, wherein the LED comprises a plurality of LED chips connecting mutually in series or in parallel.

5. The lighting device with adjustable color temperature of claim 1, wherein the color temperature of the light source of the first branch is 6000K, and the color temperature of the light source of the second branch is 2000K.

* * * * *